United States Patent [19]

Cunningham

[11] Patent Number: 4,694,855

[45] Date of Patent: Sep. 22, 1987

[54] DRILL PIPE INSIDE BLOWOUT PREVENTER

[75] Inventor: Robert A. Cunningham, Bellaire, Tex.

[73] Assignee: Hughes Tool Company - USA, Houston, Tex.

[21] Appl. No.: 869,833

[22] Filed: May 23, 1986

Related U.S. Application Data

[63] Continuation of Ser. No. 655,282, Sep. 28, 1984, abandoned.

[51] Int. Cl.[4] ..... F16K 15/04

[52] U.S. Cl. ..... 137/519.5; 137/533.11; 166/328

[58] Field of Search ..... 137/519.5, 460, 533.11; 166/328, 329

[56] References Cited

U.S. PATENT DOCUMENTS

| | | | |
|---|---|---|---|
| 3,269,463 | 8/1966 | Page, Jr. | 137/519.5 X |
| 3,850,191 | 11/1974 | Brown | 137/460 X |
| 4,049,015 | 9/1977 | Brown | 137/519.5 X |
| 4,108,203 | 8/1978 | Brown | 137/519.5 X |
| 4,155,374 | 5/1979 | Diehl | 137/519.5 |
| 4,263,936 | 4/1981 | Brown | 137/519 J X |
| 4,349,042 | 9/1982 | Shimizu | 137/460 X |

FOREIGN PATENT DOCUMENTS

| | | | |
|---|---|---|---|
| 1416352 | 9/1965 | France | 137/533.11 |
| 537849 | 1/1956 | Italy | 137/519.5 |

*Primary Examiner*—Arnold Rosenthal
*Attorney, Agent, or Firm*—James E. Bradley

[57] ABSTRACT

An inside blowout preventer for use in an earth boring drill string has features to reduce erosion. The blowout preventer has a valve body for connection into the drill string with a longitudinal passage extending through the body. The ball seat is located in the longitudinal passage. A ball storage location is located below the seat, and offset from the longitudinal passage. A ball is carried in the storage location during downward flow, and moves into the longitudinal passage to seat against the seat if the upward flow is sufficient. The storage location is located in an area of the longitudinal passage which has a much larger flow area than through the seat. The downward flow impinges on a portion of the ball. A communication passage extends from the storage location downward to a reduced diameter section of the longitudinal passage.

10 Claims, 8 Drawing Figures

DRILL PIPE INSIDE BLOWOUT PREVENTER

This application is a continuation of application Ser. No. 655,282, filed 9/28/84 now abandoned.

BACKGROUND OF THE INVENTION

1. Field of the Invention

This invention relates in general to check valve assemblies, especially those for preventing uncontrolled or excessive upward flow of fluid in drill strings used in earth boring.

2. Description of the Prior Art

Oil and gas wells are conventionally drilled by rotating a drill string of drill pipe and drill collars that support a bit. Drilling fluid, known as "mud", is pumped down the inner passage of the drill string, through the bit, and up the annular passage between the borehole wall and drill pipe. The mud circulates cuttings to the surface and cools the bit. Also, the weight of the mud is adjusted to provide a bottom hole hydrostatic pressure greater than the formation pressure to prevent a "blowout".

If the mud pressure gets too low when the surface pump is disconnected from the drill pipe (as when a joint of pipe is being added or the pipe being removed or replaced during a "trip"), fluid will flow into the hole and can result in uncontrolled upward flow up the drill string as well as up the annulus. This is called a gas kick which can result in a blowout if not quickly controlled. Also, heavier fluids with weighting materials cannot be quickly pumped through the system to prevent a blowout, because the surface pump is disconnected from the drill string.

"Outside38 blowout preventers, which have been marketed and used for years, are presently used to close around the drill pipe at the surface and seal the annulus between the pipe and the wall of the hole. These devices do not prevent the upward flow of mud inside the pipe during the blowout. "Inside38 blowout preventers are also marketed. A typical inside blowout preventer is kept on the rig floor. Once flow starts up the inside of the drill pipe, the inside blowout preventer is screwed into the top of the drill pipe, and a valve is closed. Then the mud hose is hooked back up to kill the well. Since the flow starts before connecting up the inside blowout preventer of this type, the usage can be messy and dangerous.

There have been several proposals in the patented art to use inside blowout preventers which remain with the drill string while drilling. Examples of these inside blowout preventers are shown in U.S. Pat. Nos. 3,850,191; 3,850,194; 4,040,441; 4,049,015; 4,088,298; 4,108,203; and 4,263,936. In these patents, the device comprises a sub for connection into the string. The sub has a longitudinal passage, with a recess or side pocket on one side and a valve seat in the passage above the side pocket. A ball is carried in the side pocket during normal drilling. It moves into the longitudinal passage and seats if substantial flow exists during a blowout. An equalizing passage, connecting the base of the side pocket with the longitudinal passage below the side pocket, determines the rate of upward flow which will move the ball into the longitudinal passage. The cross-sectional area of the equalizing passage prevents seating of the ball of the ball seat from the normal upward flow caused by running the drill string into the well.

Erosion is a continuing problem for inside blowout preventers of the type shown in the patented proposals. High flow rates and solids or sand contained in the mud cause erosion of the seat and passages inside the blowout preventer, preventing long-term effective operation. Experience indicates that the ball tends to move partially into the longitudinal passage even during downward fluid flow. In this position, the ball causes a flow restriction of varying area due to the oscillation of the ball resulting in excessive bluid velocities around the ball and the longitudinal passage. Turbulent flow and erosion of the passage and ball inevitably results.

SUMMARY OF THE INVENTION

In this invention, an inside blowout preventer is provided of the type that connects into the drill string during drilling operations. The inside blowout preventer has a ball which remains in a ball storage location on one side during downward flow. The ball moves upward to contact a seat during upward flow of sufficient amount.

The ball storage location is located in a portion of the sub that has a considerably greater flow area than through the seat. This greater flow area lowers the velocity of the fluid past the ball. The downward flow directly impinges on a portion of the ball. The portion of the longitudinal passage from the valve seat down to the ball can be a diffuser or diverging passage to uniformly decelerate the fluid. To further assist in keeping the ball in the storage location, a communication passage leads from a point below the ball to a point of much higher velocity and lesser cross-section area than the point at where the ball is located. Preferably, the main flow longitudinal passage leads from the ball storage location to a cylindrical section of smaller diameter. The communication passage terminates adjacent the cylindrical section to provide a pressure drop to retain the ball in the ball seat. The longitudinal passage will allow the passage of tools through the sub.

DESCRIPTION OF THE PREFERRED EMBODIMENT

Figure 1:
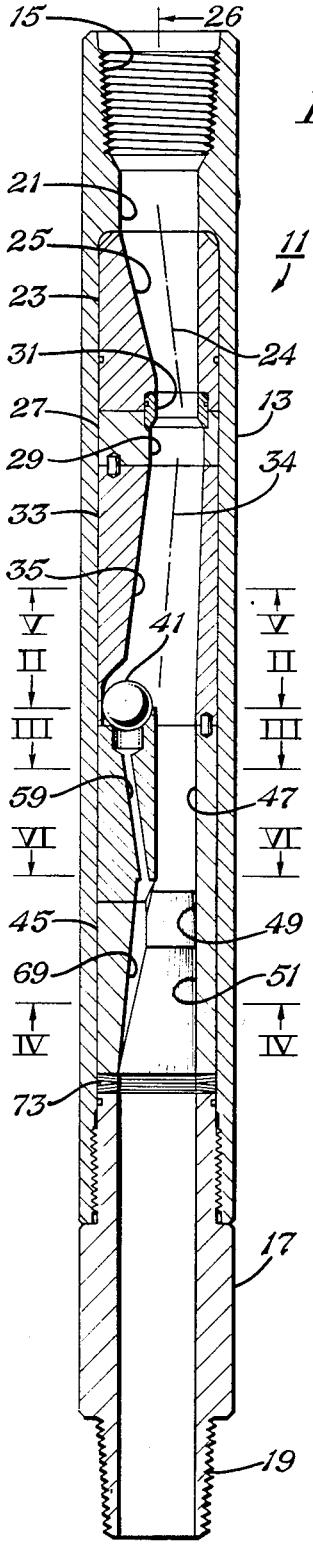
FIG. 1 is a vertical cross-sectional view of an inside blowout preventer constructed in accordance with this invention.

Referring to FIG. 1, blowout preventer 11 includes a tubular housing 13. Housing 13 has internal threads 15 at the top for connection to a drill string member (not shown). A pin adapter 17 is secured to the lower end of housing 13. Pin adapter 17 has external threads 19 for connecting to another drill string member (not shown). A longitudinal passage 21 extends through the housing 13 and adapter 17 for the passage of drilling fluid.

An upper insert 23 is located within the housing 13 near the upper end. Upper insert 23 is a tubular member with a tapered bore section 25, which forms a part of the longitudinal passge 21 for the passage of drilling fluid. Tapered section 25 is conical, with the lower end being smaller than the upper end and offset from the axis 26 of the housing 13. The axis 24 of tapered section 25 intersects axis 26.

A ball or valve seat 31 is located in a recess at the bottom of tapered passage 25. A seat retaining insert 27 joins the lower end of the upper insert 23, and also is located in the housing 13. Insert 27 is a tubular member with a cylindrical bore section 29 which aligns with the lower end of the tapered bore section 25. Valve seat 31 is retained by recesses formed in the inserts 23 and 27.

Figure 5:
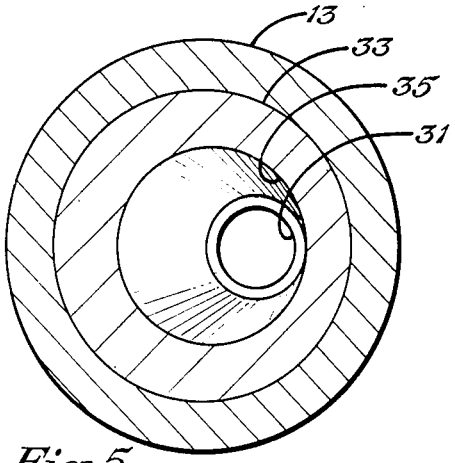
FIG. 5 is an enlarged sectional view of the blowout preventer of FIG. 1, taken along the line V—V of FIG. 1.

An intermediate insert 33 joins the lower end of the insert 27. Insert 33 is a tubular member with a bore section 35, which at its upper end is the same diameter and joins with the cylindrical bore section 29. The tapered section 35 is conical like the tapered section 25, also having an axis 34 that is inclined with respect to the axis 26, but it is inverted from the tapered section 25. FIG. 5 shows the tapered passage section 35 looking upwardly toward the seat 31.

Figure 2:
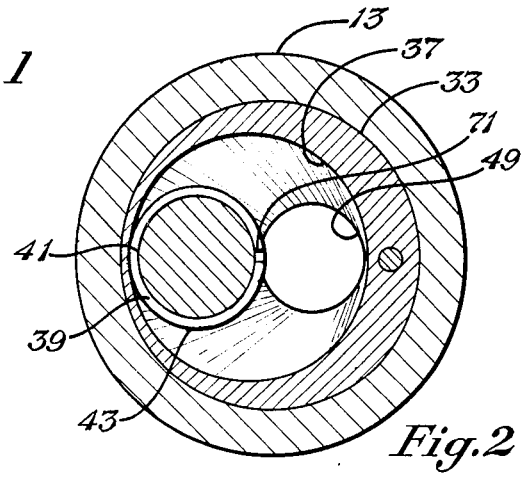
FIG. 2 is an enlarged sectional view of the blowout preventer of FIG. 1, taken along the line II—II of FIG. 1.
Figure 7:
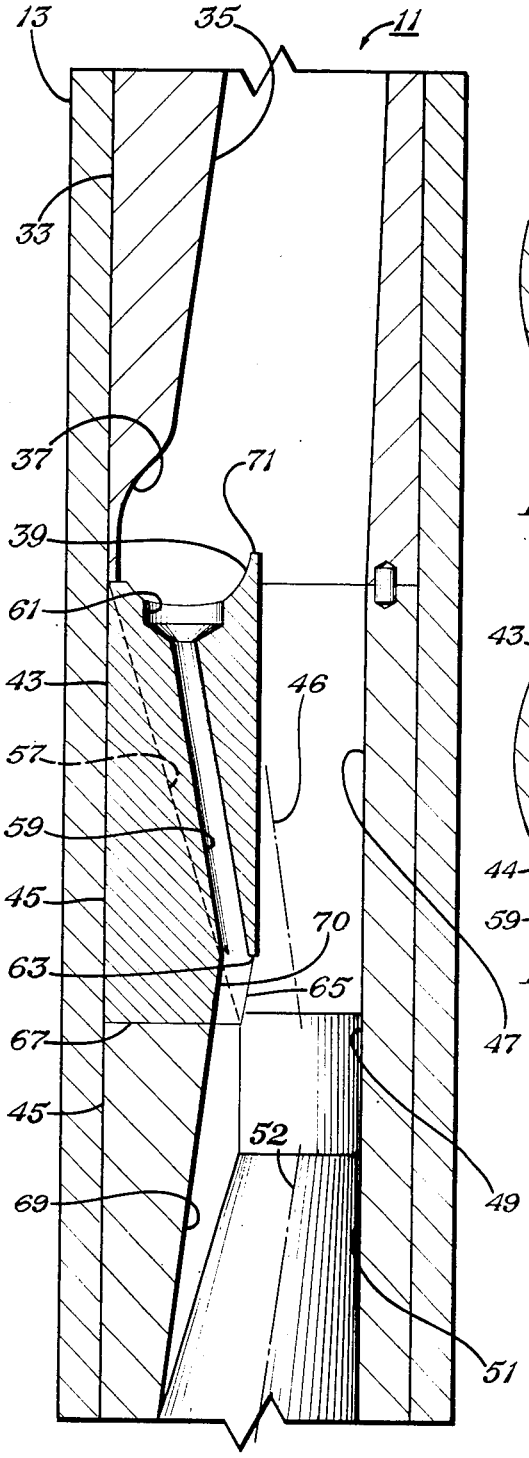
FIG. 7 is a partial, enlarged vertical sectional view of a portion of the blowout preventer of FIG. 1, and shown without the ball.

The tapered section 35 leads into an enlarged central section 37, as shown in FIGS. 2 and 7, which is generally cylindrical. The cross-sectional area, or flow area, at the central section 37 is greater than through the seat 31. The axis of the central section 37 is offset from axis 26, but in a direction opposite to the direction of offset of seat 31.

Referring still to FIG. 7, a ball storage location 39 is located within the central section 37. Ball storage location 39 supports a ball 41 (FIG. 1) during downward flow. FIG. 2 is a sectional view showing the ball 41 located on the ball storage location 39. The axis of the ball storage location 39 is offset from the axis 26 in an opposite direction from the offset of the axis of the ball seat 31 (FIG. 1). The flow area of the ball storage location 39 comprises the cross-sectional area of the central section 37, less the cross-sectional dimension of the ball storage location 39. This flow area is considerably greater than the flow area of the seat 31 (FIG. 1), which is less than the cross-sectional area of the ball 41.

As shown in FIG. 2, ball storage location 39 is circular in cross-section, with a smaller diameter than central section 37, and with its axis offset from the axis of central section 37. The outer side of ball storage location 39 is tangent to the outer side of central section 37. The flow area at central section 37 may be described as a crescent, with one edge (the left in FIG. 2) being concave and the other edge convex.

Figure 3:
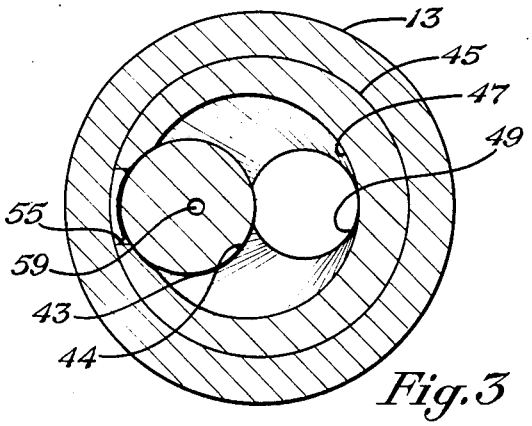
FIG. 3 is an enlarged sectional view of the blowout preventer of FIG. 1, taken along the line III—III of FIG. 1.
Figure 6:
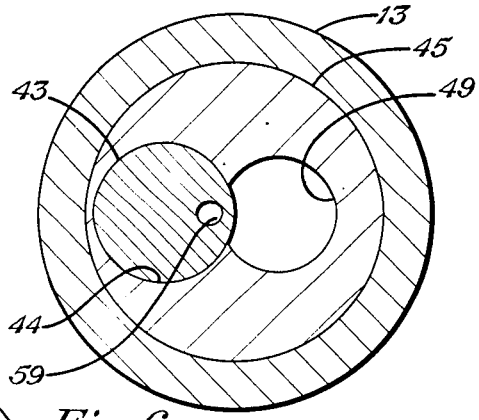
FIG. 6 is an enlarged sectional view of the blowout preventer of FIG. 1, taken along the line VI—VI of FIG. 1.

The ball storage location 39 comprises the upper end of a ball storage member 43. Ball storage member 43, as shown in FIGS. 2, 3 and 6, is a cylindrical member with a diameter slightly greater than the diameter of the ball 41. The ball storage member 43 fits within a cylindrical hole 44 (FIGS. 3 and 6), formed in a lower insert 45. Lower insert 45 is a tubular member with an upper end that contacts the lower end of the intermediate insert 33. Lower insert 45 fits within the housing 13, and has a tapered bore section 47 that extends from the top downwardly, forming a part of longitudinal passage 21. Tapered section 47 is shown in FIGS. 2 and 3 as well as FIG. 7. Tapered section 47 is also conical, with an axis 46 (FIG. 7) that is inclined with respect to axis 26, and with a smaller diameter at the lower end than at the upper end.

Figure 4:
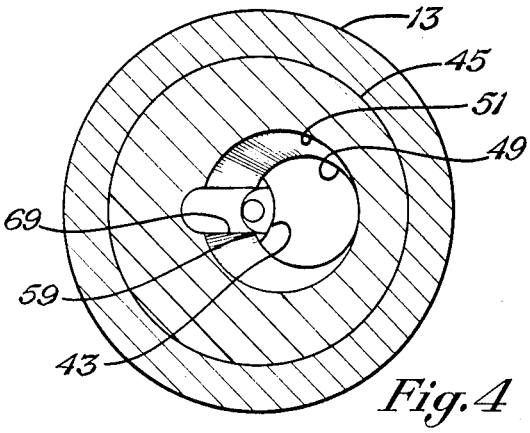
FIG. 4 is enlarged sectional view of the blowout preventer of FIG. 1, taken along the line IV—IV of FIG. 1.

The lower end of tapered section 47 leads to a cylindrical throat section 49 in lower insert 45 that is smaller in flow area than the flow area at central section 37. The axis of the cylindrical section 49 coincides with the axis of the valve seat 31, both of which are offset from the housing 13 axis 26. The cylindrical section 49 leads to a tapered bore section 51, which extends to the lower end of the lower insert 45. Tapered section 51 is conical, as shown in FIG. 4, with an axis 52 (FIG. 7) that intersects the axis 26, similar to the other tapered sections 25, 35 and 47. The lower end of tapered section 51 is larger than its upper end. Sections 47, 49 and 51 together form a venturi.

Figure 8:
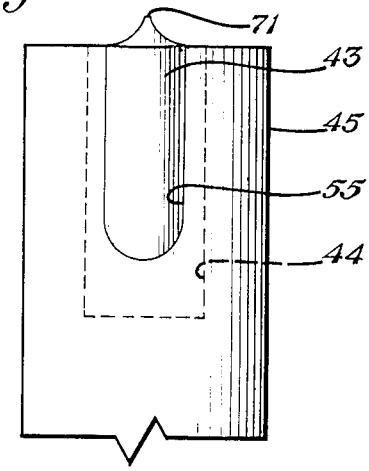
FIG. 8 is an enlarged side view of a portion of the lower insert, which is a part of the blowout preventer of FIG. 1.

Part of the lower insert 45 is shown removed from housing 13 in FIG. 8. It has a cylindrical wall which fits closely within the housing 13. On one side, a slot 55 is cut through the wall. This slot also is shown in FIG. 3. Slot 55 exposes a part of the outer side of the ball storage member 43. This allows the ball storage member 43 to be welded to the insert 45. Slot 55 does not extend the full length of the hole 44, or the ball storage member 43. The dotted line 57, as shown in FIG. 7, indicates how the tapered section 47 would appear, if the ball storage member 43 were not welded in place, and if a hole 44 did not exist. The merger of the tapered section 47 into the cylindrical section 49 can be seen by comparing FIGS. 2, 3 and 6. In FIG. 6, the tapered section 47 is no longer seen, showing only the cylindrical section 49.

Referring to FIG. 7, a communication passage 59 extends through the ball storage member 43 inclined with respect to the axis 26. The communication passage 59 has an enlarged upper end 61, which is circular, but of lesser diameter than the diameter of ball 41. The upper end 61 defines a circular sealing surface which is located in a plane, perpendicular to axis 26 (FIG. 1), for causing the ball 41 to seal against the upper end of passage 59 during downward flow. During downward flow, ball 41 will prevent any fluid from flowing downwardly in passage 59. The passage lower end 63 terminates in a beveled sectio 65. The beveled section 65 extends from the lower end 63 of passage 59 to the lower end 67 of the ball storage member 43. The beveled section 65 is a flattened section on the sidewall of ball storage member 43. The lower end 67 extends slightly into the cylindrical section 49.

An open channel 69 extends upwardly from a point near the lower end of insert 45 to the lower end of storage member 43. Channel 69 is formed in the wall of tapered bore section 51. Channel 69 aligns with a channel 70 that extends upward from the lower end 67 of the ball storage member 43 to the lower end 63 of the communication passage 59. As shown in FIG. 4, the channel 69 joins channel 70 to provide a flow path for upward flow into the lower end 63 of the passage 59. Channels 69 and 70 are inclined with respect to the axis 26 (FIG. 1).

Additional structure for the blowout preventer 11 includes a tooth shaped guide member 71, which is located on the inner side of the ball storage location 39. As shown in FIG. 8, guide member 71 forms a crest above the upper end 61 of passage 59. Guide member 71 serves as a guide means to assist the ball 41 in locating within the ball storage loation 39 during downward flow. FIG. 1 shows belleville springs 73, which are located between the adapter 17 and the lower end of the lower insert 45 for retaining the inserts 23, 27, 33 and 45 tightly within the housing 13.

In operation, the blowout preventer 11 is secured into the drill string while drilling. Drilling mud is pumped down the drill string, passing through the blowout preventer 11. The drilling fluid will pass through the longitudinal passage 21, tapered section 25, and seat 31. The drilling fluid passes through the cylindrical section 29, then enters the tapered section 35.

As shown in FIG. 1 and FIG. 5, the gradually increasing cross-sectional area or flow area of the tapered section 35 results in a diffuser under downward flow. The fluid velocity will decrease to a minimum in the vicinity of the central section 37. The fluid flows around the ball storage member 43, entering the tapered section 47. Some of the downward fluid stream impinges directly on ball 41. In tapered section 47, the velocity of the fluid will increase, reaching a maximum velocity in cylindrical section 49. The pressure at the cylindrical section 49 will be less than the pressure in the central section 37.

The ball storage location 39 is in communication with the lower pressure adjacent cylindrical section 49 by means of the communication passage 59. This creates a pressure differential on ball 41. Normally, under downward flow the ball 41 will not move out into the main flow area on the other side of the guide member 71. Even if ball 41 did move off of storage location 39, the distance between the ball storage member 43 and the opposite side of the tapered section 47 is smaller than the dimension of the ball 41, thus it could not move downwardly. Also, as can be seen in FIG. 2, even if the ball 41 happens to move from ball location 39 and contact the opposite wall of the tapered section 47, it will not greatly restrict the flow, because of the large crescent shaped flow area surrounding the ball storage member 43. The fluid flow, once leaving the cylindrical section 49 enters tapered section 51, and flows through adapter 17.

If the formation pressure in the well becomes greater than the hydrostatic pressure due to the column of mud, and if fluid starts flowing upwardly, then the drilling fluid may start flowing up the inside of the drill pipe. The flow upward will flow through the tapered section 47, which now acts as a diverging section. Some of the flow will flow upwardly through the communication passage 59. The fluid flowing through the communication passage 59, if sufficient, unseats ball 41, pushing it into the mainstream of flow up the tapered section 35. Ball 41 will flow upward to seat against the ball seat 31, stopping further upward flow. The well can then be killed by pumping into the well with heavier mud. The ball 41 will remain against seat 31 until the pressure above the ball 41 is greater than below. When the pressure above the ball 41 is greater than below, ball 41 will fall and return to the ball location 39. Guide member 71 will guide the ball back to the ball location 39.

The dimensions of the components in the blowout preventer 11 are selected so that a minimum upward flow must be achieved before ball 41 will move upward and seat against ball seat 31. For ball 41 to contact seat 31, a minimum upward velocity is necessary, so that the ball 41 will not normally move into contact with seat 31 during normal "running-in" of the drill string. During running-in, mud in the borehole will enter the string to equalize the pressure inside and outside the drill pipe. The ball 41 and the various bore sections are dimensioned so that the ball will contact seat 31 preferably during upward flow rates of about 150 gallons per minute for drilling fluid having a weight of 16 pounds per gallon, and 200 gallons per minute for clear water. The maximum upward flow rate expected during normal running-in, even with large nozzles and heavy mud, is about 134 gallons per minute.

The minimum clearances through valve seat 31 and cylindrical section 49 are selected so as to allow normal wireline tools to be lowered into the drill string during certain operations. The distance between the extreme inner side of the ball storage member 43 and the opposite side of the tapered section 47 is calculated to allow the same tools to pass.

The dimensions of the bore sections are selected to reduce erosion during normal downward flow. A flow velocity of approximately 100 feet per second is assumed herein as a value at which erosion would begin for most muds. The smallest flow area in the blowout preventer 11 is the ball seat 31, at which velocities of 100 feet per second occur with 750 gallons per minute flow, assuming an inner diameter of $1\frac{3}{4}$ inch for seat 31. A velocity of 100 feet per second through seat 31 reduces to about 43 feet per second when in the central section 37 around ball 41. This reduced velocity is well below the assumed erosional threshold.

The lower end 63 of the communication passage 59 is preferably in a portion of the tapered section 47 that has a flow area less than the flow area around the ball storage location 39. This results in a pressure differential on ball 41 during downward flow, the magnitude of which depends upon the fluid velocity and drilling fluid weight. For example, at 200 gallons per minute, the estimated pressure differential would range from 2.39 pounds per square inch for water to 4.59 pounds per square inch for 16 pound per gallon drilling mud.

In the preferred embodiment, the diameter of seat 31 is $1\frac{3}{4}$ inch, providing a flow area of 2.41 square inches. The nominal flow area of central section 37 is approximately $5\frac{1}{2}$ square inches. The distance along axis 26 from the lower edge of seat 31 to the top of ball 41 while on storage location 39 is approximately 11 inches. The ball is preferably steel and has a diameter of $2\frac{1}{8}$ inches. The flow area of the cylindrical section 49 is approximately 3 square inches which is approximately 55% of the flow area of central section 37. The distance from the centerline of ball 41 while on storage location 39 to the upper edge of cylindrical section 49 is approximately 8 inches. The diameter of communication passage 59 is 5/16 inch.

The diameter of section 35 at its junction with central section 37 is about $2\frac{5}{8}$ inches. The diameter of central section 37 is about $3\frac{7}{8}$ inches. The main flow stream at the top of central section 37 is conical. The edge of the conical flowstream will impinge on ball 41 approximately $1\frac{1}{2}$ inches from the inner side (right side in FIG. 1) of ball 41. Thus, approximately $\frac{3}{4}$ of the ball will be directly in the main downward flowstream in the preferred embodiment.

The invention has significant advantages. The streamlined nature of the converging and diverging passages, and the placing of the ball storage location in a point of greatly reduced velocity, reduces erosion substantially. Utilizing the pressure differential caused by the communication passage below the ball keeps the ball in the ball location to prevent oscillation and turbulence. The offset axis of the converging and diverging sections in the ball seat allow wireline tools to easily pass through the blowout preventer.

While the invention has been shown in only one of its forms, it should be apparent to those skilled in the art that it is not so limited but is susceptible to various changes without departing from the scope of the invention.

I claim:

1. An inside blowout preventer for use in a drill string, comprising in combination:

a valve body having a central axis, a longitudinal passage with an upper inlet and a lower outlet for the passage of fluid, and upper and lower ends for connection to the drill string, the longitudinal passage having a central section with an axis;

a ball seat located in the longitudinal passage and facing toward the outlet;

a ball adapted to be carried in the longitudinal passage below the ball seat;

a ball storage member located below the seat and having on its upper end an upwardly facing socket means for receiving the ball and for preventing the ball from lateral movement during downward fluid flow past the ball, the socket means including a concave socket facing the inlet and laterally offset from the axis of the central section;

the ball being carried in the socket means during downward flow, and being movable in case of upward flow of sufficient velocity from the outlet to the inlet into the longitudinal passage and into contact with the seat to stop the upward flow; and the socket means substantially extending into the longitudinal passage, exposing the ball to a portion of the direct inpingement of downward flowing fluid while the ball is located on the socket means.

2. An inside blowout preventer for use in a drill string comprising in combination:

a valve body having a longitudinal passage with an upper inlet and a lower outlet for the passage of fluid and upper and lower ends for connection to the drill string;

a ball seat located in the longitudinal passage and facing toward the outlet;

a ball adapted to be carried in the longitudinal passage below the ball seat;

a diffuser section within the longitudinal passage, beginning with a minimum flow area at the valve seat and gradually increasing in flow area in a downward direction to provide a lower velocity of fluid at the lower end of the diffuser section than at the upper end, the diffuser section having a length substantially greater than the diameter of the seat;

a ball storage member having an upper end at the lower end of the diffuser section containing a socket for snugly receiving the ball to prevent the ball from lateral movement during downward flow past the ball, the socket having a rim facing toward the inlet;

the ball being carried in the socket during downward flow and being movable from the socket upwardly into contact with the seat to block upward flow if upward flow of a selected velocity occurs; and guide means located above the socket for preventing the ball from rolling around the rim in a circular path and for guiding the ball onto the socket.

3. An inside blowout preventer for use in a drill string, comprising in combination:

a valve body having a central axis, and upper and lower ends for connection to the drill string;

a longitudinal passage with an upper inlet and a lower outlet extending through the body for the passage of fluid;

a ball seat located in the upper section and facing toward the outlet;

a ball adapted to be carried in the longitudinal passage below the ball seat;

a diffuser section within the longitudinal passage, beginning with a minimum flow area a selected distance below the valve seat and gradually increasing in flow area in a downward direction to provide a lower velocity of fluid at the lower end of the diffuser section than at the upper end, the diffuser section having a length substantially greater than the diameter of the seat;

a generally cylindrical central section joining the lower end of the diffuser section and being of larger diameter than the lower end of the diffuser section;

a ball storage member having an upper end located in the central section of the longitudinal passage containing a socket for snugly receiving the ball to prevent the ball from lateral movement during downward flow past the ball, the socket being laterally offset from the axis of the central section and facing the inlet; and in case of upward flow of sufficient velocity from the outlet to the inlet, the ball being movable from the socket to the seat to block the upward flow.

4. An inside blowout preventer for use in a drill string, comprising in combination:

a valve body having a longitudinal passage with an upper inlet and a lower outlet for the passage of fluid, and upper and lower ends for connection to the drill string;

a ball seat located in the longitudinal passage and facing toward the outlet;

a ball adapted to be carried in the longitudinal passage below the ball seat;

a ball storage member having an upper end located below the seat in a central section of the longitudinal passage and containing a socket facing the inlet for snugly receiving the ball to prevent the ball from lateral movement during downward flow past the ball, the socket being generally circular in cross section, with an axis offset from the axis of the central section, which is also circular, defining a generally crescent-shaped flow area at the socket;

the ball adapted to be carried in the socket during downward flow and in case of upward flow from the outlet to the inlet of sufficient velocity, the ball being movable into contact with the seat to stop the upward flow; and the crescent shape of the flow area at the socket preventing the ball from blocking downward flow should the ball be off of the socket during downward flow.

5. An inside blowout preventer for use in a drill string, comprising in combination;

a valve body, having a central axis and upper and lower ends for connection to the drill string;

a longitudinal passage extending through the body for the passage of fluid with an upper inlet and a lower outlet for the passage of fluid, and having upper and lower sections with smaller flow area portions than a central section;

a ball seat located in the upper section and facing toward the outlet;

a ball adapted to be carried in the longitudinal passage below the ball seat;

the upper section having a diffuser section beginning with a minimum flow area a selected distance below the ball seat and gradually increasing in flow area in a downward direction to provide a lower velocity of fluid at the lower end of the diffuser section than at the upper end;

a ball storage member having an upper end containing a socket facing the inlet for snugly receiving the ball and located in the central section of the longitudinal passage, the socket being offset from the central axis;

the ball being movable between the socket and the seat; and a communication passage leading from the socket downwardly and inwardly at an inclination relative to the central axis to a smaller flow area portion of the lower section to provide a pressure differential on the ball during downward flow to retain the ball on the socket, and to assist in moving the ball to the seat during upward flow from the outlet to the inlet of predetermined velocity to block the upward flow.

6. An inside blowout preventer for use in a drill string, comprising in combination:

a valve body having upper and lower ends for connection to the drill string;

a longitudinal passage with an upper inlet and a lower outlet extending through the body, having an upper diverging section, a converging section located below the lower end of the diverging section, a cylindrical throat section joining the lower end of the converging section, and a lower diverging section joining the lower end of the throat section, the throat section having a smaller flow area than the lower end of the upper diverging section;

a ball seat located at the upper end of the upper diverging section and facing toward the outlet, the ball seat being coaxial with the throat section and offset from the axis of the body;

a ball adapted to be carried in the longitudinal passage below the ball seat;

a ball storage member having an upper end containing a socket facing the inlet for snugly receiving the ball, the socket being located at the upper end of the converging section and offset from the axis of the body in a direction opposite to the ball seat;

in case of upward flow of sufficient velocity from the outlet to the inlet, the ball being movable from the socket to the seat to block the upward flow; and communication passage means leading through the ball storage member from the socket to the vicinity of the throat section for communicating during downward flow lower pressure to the lower side of the ball than in the upper diverging section adjacent the socket to retain the ball in the socket, and for diverting a portion of upward flow to below the ball to assist the ball in movement into the upward flow and up against the seat to block the upward flow if a predetermined upward flow velocity is reached;

the coaxial alignment of the seat and throat section and the offset of the socket allowing the passage of tools through the longitudinal passge, with the lower diverging section facilitating pulling tools upwardly through the longitudinal passage.

7. An inside blowout preveter for use in a drill string, comprising in combination:

a valve body having upper and lower ends for connection to the drill string;

a longitudinal passage with an upper inlet and a lower outlet extending through the body, the longitudinal passage having an upper section, a central section, and a lower section with a reduced diameter portion having a smaller flow area than in the central section;

a ball seat located in the upper section and facing toward the outlet, coaxial with the reduced diameter portion and offset from the axis of the body;

a ball adapted to be carried in the longitudinal passage below the ball seat;

a ball storage member having an upper end containing a socket facing the inlet for snygly receiving the ball and located in the central section and offset from the axis of the body in a direction opposite to the ball seat;

the ball being carried in the socket during downward flow, and in case of upward flow from the outlet to the inlet of sufficient velocity, the ball being movable into the longitudinal passage and into contact with the seat to stop the upward flow;

the socket extending substantially into the longitudinal passage, exposing a portion of the ball to direct impingement of downward flowing fluid; and communication passage means extending from the socket to the reduced diameter portion for communicating lower pressure to the lower side of the ball than in the central section during downward flow, and to assist in moving the ball to the seat during upward flow from the outlet to the inlet;

the coaxial alignment of the seat and reduced diameter portion and the offset position of the socket allowing the passage of tools through the longitudinal passage.

8. An inside blowout preventer for use in a drill string, comprising in combination;

a valve body, having a central axis and upper and lower ends for connection to the drill string;

a longitudinal passage extending through the body with an upper inlet and a lower outlet for the passage of fluid, and having upper and lower sections with smaller flow area portions than a central section;

a ball seat located in the upper section and facing toward the outlet;

a ball adapted to be carried in the longitudinal passage below the ball seat;

the upper section having a diffuser section beginning with a minimum flow area at the ball seat and gradually increasing in flow area in a downward direction to provide a lower velocity of fluid at the lower end of the diffuser section than at the upper end;

a ball storage member having an upper end containing a socket facing the inlet for snugly receiving the ball and located in the central section of the longitudinal passage, the socket being offset from the central axis;

the ball being movable between the socket and the seat;

a communication passage leading from the socket downwardly to a smaller flow area portion of the lower section to provide a pressure differential on the ball during downward flow to retain the ball in the socket, and to assist in moving the ball to the seat during upward flow from the outlet to the inlet of predetermined velocity to block the upward flow; and the socket having a rim with an upwardly projecting toothed-shaped member thereon to guide the ball into the socket.

9. An inside blowout preventer for use in a drill string, comprising in combination:

a valve body having upper and lower ends for connection to the drill string;

a longitudinal passage extending through the body with an upper inlet and a lower outlet, and having upper, central and lower sections, with the lower section having a reduced diameter portion with a flow area smaller than in the central section;

a ball seat located in the upper section and facing toward the outlet;

a ball adapted to be carried in the longitudinal passage below the ball seat;

a ball storage member having an upper end containing a socket for snugly receiving the ball and located in the central section of the longitudinal passage, the socket being generally circular in cross section, with an oaxis offset from the axis of the central section, which is also circular in cross-section, defining a generally crescent-shaped flow area at the socket;

the ball being carried in the socket during downward flow, and in case of upward flow of sufficient velocity from the outlet to the inlet, the ball being movable into the longitudinal passage and into contact with the seat to stop the upward flow; and a communication passage leading from the socket to the reduced diameter portion.

10. An inside blowout preventer for use in a drill string comprising in combination:

a valve body having upper and lower ends for connection to the drill string;

a longitudinal passage extending through the body with an upper inlet and a lower outlet for the passage of fluid, having an upper section tapering gradually to a central section with a larger flow area and a lower section tapering gradually downwardly from the central section to a smaller flow area portion;

a ball seat located in the upper section and facing toward the outlet, the length of the upper section being substantially greater than the diameter of the seat;

a ball storage member having an upper end containing a concave socket facing the inlet for snugly receiving the ball and located in the central section of the longitudinal passage;

in case of upward flow from the outlet to the inlet of sufficient velocity, the ball being movable from the socket to the seat; and a generally tooth-shaped guide member projecting upwardly from an edge of the socket for guiding the ball into the socket.

* * * * *

UNITED STATES PATENT OFFICE

CERTIFICATE OF CORRECTION

Patent No. 4,694,855 Dated September 22, 1987

Inventor(s) Robert A. Cunningham

It is certified that error appears in the above-identified patent and that said Letters Patent are hereby corrected as shown below:

| | | |
|---|---|---|
| Col. 1 | line 36, | "'Outside 38'" is changed to--Outside--; |
| Col. 1 | line 41, | "'Inside38'" is changed to--Inside--; |
| Col. 2 | line 10, | "bluid" is changed to--fluid--; |
| Col. 3 | line 15, | "passge" is changed to--passage--; |
| Col. 4 | line 51, | "sectio" is changed to--section--; |
| Col. 5 | line 7, | "loation" is changed to--location--; |
| Col. 10 | line 25, | "snygly" is changed to--snugly--; |
| Col. 11 | line 34, | "oaxis" is changed to--axis--. |

Signed and Sealed this

First Day of November, 1988

*Attest:*

DONALD J. QUIGG

*Attesting Officer*

*Commissioner of Patents and Trademarks*